US005857803A

United States Patent [19]

Davis et al.

[11] Patent Number: 5,857,803

[45] Date of Patent: Jan. 12, 1999

[54] PORTABLE VIBRATORY WET SCREED

[76] Inventors: Larry L. Davis, 1229 Eagle Pointe Dr., Little Rock, Ark. 72211; Roy K. Frazier, 105 Meadowpointe West, Hendersonville, Tenn. 37075

[21] Appl. No.: 806,989

[22] Filed: Feb. 26, 1997

[51] Int. Cl.[6] ..... E01C 19/38; E01C 19/22; B05C 17/10

[52] U.S. Cl. ..... 404/102; 404/114; 404/118; 15/235.4

[58] Field of Search ..... 404/96, 97, 102, 404/113, 114, 118, 120, 117; 15/235.4

[56] References Cited

U.S. PATENT DOCUMENTS

| | | | |
|---|---|---|---|
| 1,780,427 | 11/1930 | Kirkham | 15/235.4 |
| 2,141,301 | 12/1938 | Jackson | 94/48 |
| 2,180,198 | 11/1939 | Day | 94/46 |
| 2,289,248 | 7/1942 | Davis | 94/24 |
| 2,395,399 | 2/1946 | Davis | 94/45 |
| 2,453,510 | 11/1948 | Jackson | 94/48 |
| 2,633,782 | 4/1953 | Clement | 94/49 |
| 2,737,094 | 3/1956 | Jackson | 94/48 |
| 3,314,341 | 4/1967 | Schulin et al. | 94/48 |
| 3,698,293 | 10/1972 | Wagner | 404/117 |
| 3,871,788 | 3/1975 | Barsby | 404/117 |
| 3,909,147 | 9/1975 | Takata | 404/117 |
| 4,145,156 | 3/1979 | Grane | 404/113 |
| 4,431,336 | 2/1984 | Nightengale et al. | 404/97 |
| 4,591,291 | 5/1986 | Owens | 404/118 |
| 4,641,995 | 2/1987 | Owens | 404/118 |
| 4,650,366 | 3/1987 | Morrison | 404/114 |
| 4,653,957 | 3/1987 | Smith et al. | 404/114 |
| 4,702,641 | 10/1987 | Naser et al. | 404/97 |
| 4,838,730 | 6/1989 | Owens | 404/114 |
| 5,234,283 | 8/1993 | Adkins | 404/97 |
| 5,244,305 | 9/1993 | Lindley | 404/97 |
| 5,261,762 | 11/1993 | Yamaguchi | 404/133.05 |
| 5,375,942 | 12/1994 | Lindley et al. | 404/97 |
| 5,417,517 | 5/1995 | Zollers | 404/113 |
| 5,540,519 | 7/1996 | Weber | 404/102 |
| 5,632,569 | 5/1997 | Szmansky | 404/97 |

FOREIGN PATENT DOCUMENTS

| | | | |
|---|---|---|---|
| 141685 | 6/1951 | Australia . | |
| 1227346 | 8/1960 | France . | |
| 1417130 | 10/1965 | France . | |
| 4-343974 | 11/1992 | Japan | 404/97 |
| 173454 | 11/1960 | Sweden . | |
| 613900 | 12/1948 | United Kingdom . | |
| 618510 | 2/1949 | United Kingdom . | |
| 2192418 | 1/1988 | United Kingdom . | |

OTHER PUBLICATIONS

Advertisement, Allen Engineering Steel Screeds, No Date.
Advertisement, Burke Tiger Vibrators, No Date.
Advertisement, Cronkhite Industries Screed Vibe, No Date.
Advertisement, Metal Forms Corp. Speed Screed, No Date.
Advertisement, Morrison's Screed, No Date.
Advertisement, Whiteman Portable Screeding Machines, No Date.
Landberg, Lynn, "Side–to–Side Action", No Date.

*Primary Examiner*—Thomas B. Will
*Assistant Examiner*—Gary S. Hartman
*Attorney, Agent, or Firm*—Aquilino & Welsh

[57] ABSTRACT

A portable vibratory concrete screed is disclosed. The concrete screed includes a screed blade including a flat bottom wall extending between a front edge of the screed blade and a rear edge of the screed blade. The screed also includes a vibratory assembly, with an eccentric weight, coupled to the screed blade, wherein the eccentric weight rotates in a plane which is oblique to the bottom wall of the screed blade. Finally, the screed includes a handle assembly extending from the vibratory assembly and coupling a motor to the vibratory assembly to drive the eccentric weight and vibrate the screed blade.

20 Claims, 5 Drawing Sheets

PORTABLE VIBRATORY WET SCREED

BACKGROUND OF THE INVENTION

1. Field of the Invention

The present invention relates to concrete screeds. More particularly, the present invention relates to extremely light weight, single operator, portable power vibratory "Wet Screeds" used to smooth and level freshly poured concrete without the use of forms or other devices to ride or rest on. The wet screeds float on the concrete as it tamps and smooths.

2. Description of the Prior Art

Numerous screeds employ vibratory action to tamp and smooth concrete in the final finishing step. U.S. Pat. No. 4,340,351 describes a vibratory concrete screed used in the final finishing of concrete. This screed requires two operators. U.S. Pat. No. 4,641,995 describes a vibratory concrete screed which rides on forms to screed narrow strips of concrete, such as walks. This screed is mounted on the operator via a complicated harness counter-weighted frame and is powered by electricity. As a result, the screed requires electrical power on site and the screed requires manipulation of lengthy extension cords.

Escalating labor costs and the unavailability of qualified concrete helpers have pushed the concrete finishers' profitability margin down continually, thus forcing rising costs of construction nationwide. The current standard method of "Wet Screeding" freshly poured concrete is with a 2" by 4" board 8' to 20' long with one or two men hand working the concrete all day long as two to four laborers, "puddlers", push the fresh concrete, "mud", in place with concrete rakes. The hand process is not only slow, inefficient and labor intensive, it is also often requires the addition of more water to the concrete mix to make it more workable. The additional water reduces the strength of the concrete, causing voids and weak spots. The addition of water to produce slumps of 6" to 8", so the finisher can effectively hand "Wet Screed" the fresh concrete, is common in the industry nationwide today. The hand process limits the finisher to the average pour of 6,000 to a maximum of 8,000 square feet of slab per day for a crew of six.

In view of the shortcomings of hand processing wet concrete and prior vibratory screeds, a need exists for a wet screed which effectively and efficiently prepares wet concrete for use. The present invention provides such a screed.

SUMMARY OF THE INVENTION

It is, therefore, an object of the present invention to provide a portable vibratory concrete screed. The concrete screed includes a screed blade including a flat bottom surface extending between a front edge of the screed blade and a rear edge of the screed blade. The screed also includes a vibratory assembly, with an eccentric weight, coupled to the screed blade, wherein the eccentric weight rotates in a plane which is oblique to the bottom surface of the screed blade. Finally, the screed includes a handle assembly extending from the vibratory assembly and coupling a motor to the vibratory assembly to drive the eccentric weight and vibrate the screed blade.

It is also object of the present invention to provide a portable vibratory concrete screed wherein the eccentric weight rotates in a plane which is 60° relative to the bottom surface of the screed blade.

It is another object of the present invention to provide a portable vibratory concrete screed wherein the vibratory assembly includes a drive shaft upon which the eccentric weight is mounted, the eccentric weight being mounted offset on the drive shaft.

It is a further object of the present invention to provide a portable vibratory concrete screed including a screed blade mounting assembly coupling the vibratory assembly to the screed blade.

It is also an object of the present invention to provide a portable vibratory concrete screed wherein the screed blade mounting assembly includes mounting brackets supporting the vibratory assembly above the screed blade.

It is another object of the present invention to provide a portable vibratory concrete screed wherein the handle assembly is coupled to the mounting assembly, and a vibratory pad is positioned between the handle assembly and the mounting assembly to lessen vibrations transmitted to a user.

It is a further object of the present invention to provide a portable vibratory concrete screed wherein the handle assembly is coupled to the mounting assembly, and an O-ring is positioned between the handle assembly and the mounting assembly to lessen vibrations transmitted to a user.

It is also an object of the present invention to provide a portable vibratory concrete screed wherein the vibratory assembly includes an end cap secured to the mounting assembly to encase the eccentric weight.

It is another object of the present invention to provide a portable vibratory concrete screed wherein the vibratory assembly includes at least one bearing on the drive shaft to lessen vibrations.

It is a further object of the present invention to provide a portable vibratory concrete screed wherein the motor is secured to the distal end of the handle assembly.

It is also an object of the present invention to provide a portable vibratory concrete screed wherein the handle assembly includes a handle mounting bracket supporting a handle.

It is another object of the present invention to provide a portable vibratory concrete screed wherein the handle is adjustably mounted on the handle mounting bracket for adjustment to suit users of different sizes.

It is a further object of the present invention to provide a portable vibratory concrete screed wherein the screed blade has a triangular cross section.

It is also an object of the present invention to provide a portable vibratory concrete screed wherein the screed blade is formed from a hollow extrusion.

It is another object of the present invention to provide a portable vibratory concrete screed wherein the screed blade is less than 12 feet in length.

It is a further object of the present invention to provide a portable vibratory concrete screed wherein the screed blade is an elongated tubular screed blade which is triangular in cross section and includes a pair of opposed sides, a bottom and a pair of opposed ends, thereby forming an enclosed triangular blade.

It is also an object of the present invention to provide a portable vibratory concrete screed wherein the screed blade is an elongated, enclosed, hollow screed blade including a front 60 degree concrete engaging edge and surface, a rear 60 degree concrete engaging edge and surface and a flat bottom surface extending between the front and rear edges.

It is another object of the present invention to provide a portable vibratory concrete screed wherein a drive shaft couples the motor to the eccentric weight.

It is a further object of the present invention to provide a portable vibratory concrete screed wherein an upper drive shaft is coupled to the motor and a lower drive shaft is coupled to the eccentric weight, and the lower drive shaft is coupled to the upper drive shaft by a flexible shaft connector.

The present invention allows the "Wet Screeding" of 2" to 9" slump concrete quickly and efficiently with only one operator and two puddlers, while doubling the potential daily pour to 13,000 to 16,000 square feet per day; literally as fast as the concrete trucks can pour it. The increased efficiency also doubles the income potential of the concrete finisher. Simultaneously, the present screed, with its floating vibratory action, produces a much higher quality slab having greater strength, no voids and no weak spots. The present screed also allows one additional hour for final finishing by working the rock down and bringing the fat to the surface.

In addition to doubling the potential surface area that may be efficiently wet screeded each day, the present screed's light weight portability and single operator ease of operation reduces the required crew size from the six (6) workers normally required with conventional hand wet screeding methods to four (4) workers.

Even doubling the area of production, the crew and operator of the present screed are vastly less physically fatigued at days end due to the ease of operation of the invention and its efficient high quality work. This is one of the most valuable benefits of the invention since it is directly beneficial to the health and well being of both operator and crew.

Additionally, due to the invention's light weight an operator can when required, utilize the device as a bull float temporarily, with the power vibratory action on idle, to smooth out a spot or two inadvertently missed by the operator.

Further, due to the triangular design of the screed blade, the present screed may be used as a straight edge to check the flatness of the slab after the slab has been powered troweled. With the power vibratory action on idle, the screed can be pulled along the surface of the slab. If a hump or bump is detected (by vibrations at the screed blade), the operator pushes the present screed back, applies a little throttle, and the sharp cutting edge of the screed blade will cut through and peel the bump off the surface of the slab.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
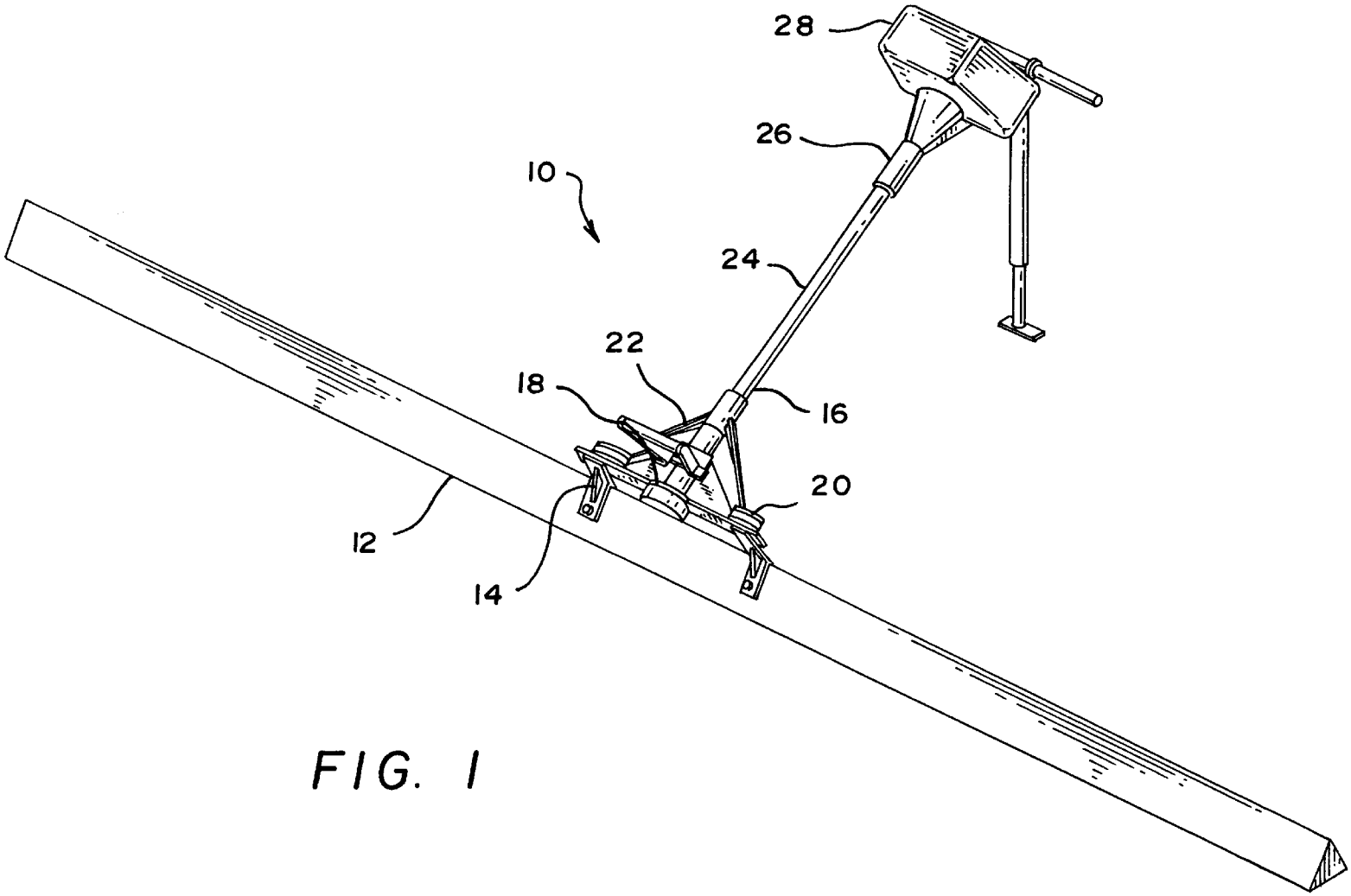
FIG. 1 is a perspective view of the present screed.

The detailed embodiment of the present invention is disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, the present screed 10 is shown to include a screed blade 12, a mounting assembly 14 and a vibratory assembly 16. Briefly, the vibratory assembly 16 includes a vibratory system 18, a lower screed casting 20, a lower unit mounting bracket 22, a stainless outer tube 24, a handle assembly 26 and a motor 28.

The screed blade 12 is triangular in cross-section and includes a bottom wall 30, a front wall 32, a rear wall 34, a front concrete engaging edge 36, and a rear concrete engaging edge 38. The ends of the screed blade 12 are covered by end plates 40 to form a watertight, tubular enclosure. While the preferred embodiment of the screed blade 12 is disclosed as having a triangular cross-section, various other geometric shapes are contemplated as long as the front and rear concrete engaging edges 36, 38 are angled at approximately 60 degrees, see FIGS. 1 and 8. The screed blade 12 may be made from various materials but aluminum has been found to be the most satisfactory.

In accordance with the preferred embodiment of the present invention, the screed blade 12 produces a nearly finished, high quality slab in the "Wet Screeding" of freshly poured concrete. The bottom wall 30, front wall 32 and rear wall 34 form an equilateral triangle where the walls are set at 60 degrees relative to each other. Each of the walls has a width of 6" and a length of approximately 12' to 16'. The screed blade 12 is made from of 1/16" thick aluminum.

The screed blade's smooth 6" base of 1/16" thick aluminum, combined with the unique 60 degree angled enclosed equilateral triangular screed blade walls and the power vibratory action of the present screed, quickly work the rock down and bring the fat to the surface, producing a very smooth, nearly finished slab to grade. This action produces a top quality slab and adds one hour to the final finishing time, greatly enhancing the quality and doubling the potential surface area which a crew can efficiently produce each day with less overhead. In addition, the light weight, enclosed triangular 60 degree design, allowing the screed to float on the surface of freshly poured concrete, combined with the power vibratory action forcing the rock down, allows the 60 degree concrete engaging edges to cut down high spots as needed by lowering the handle, or to float over, and tamp down, high spots (to maintain a proper grade) by raising the handle.

Figure 2:
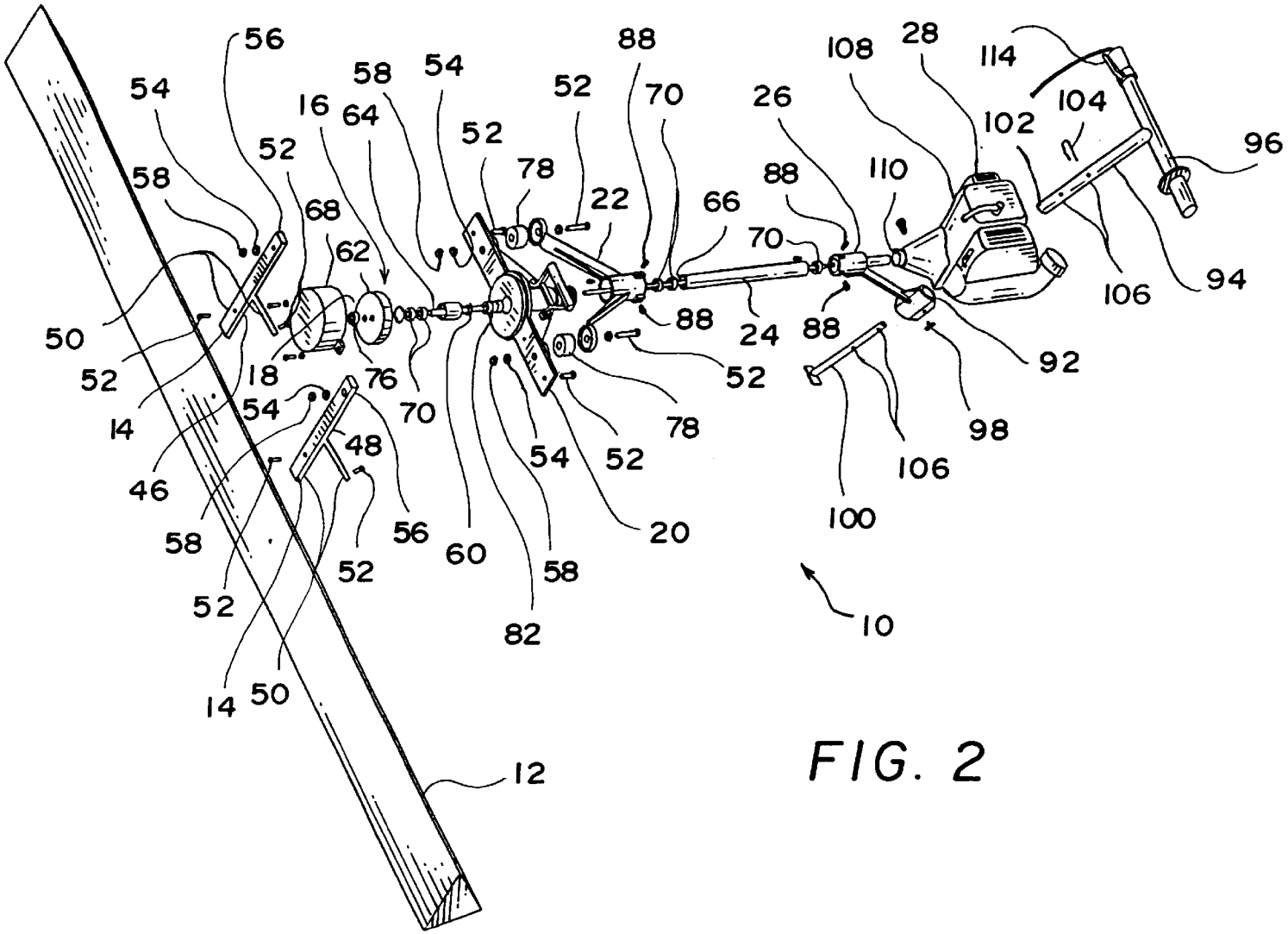
FIG. 2 is an exploded view of the present screed.
Figure 3:
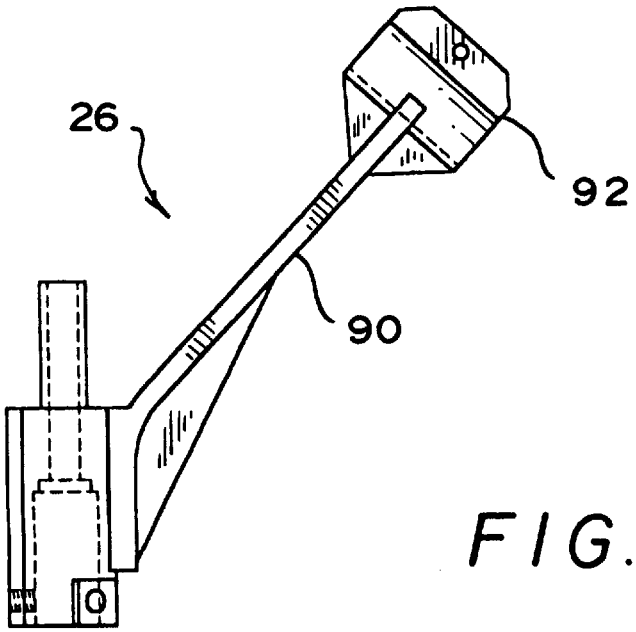
FIG. 3 is a side view of the handle assembly.
Figure 6:
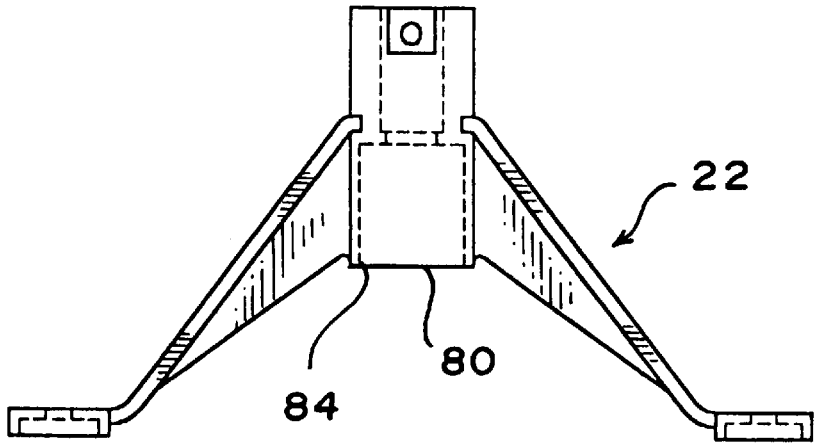
FIG. 6 is a side view of the lower unit mounting bracket.
Figure 5:
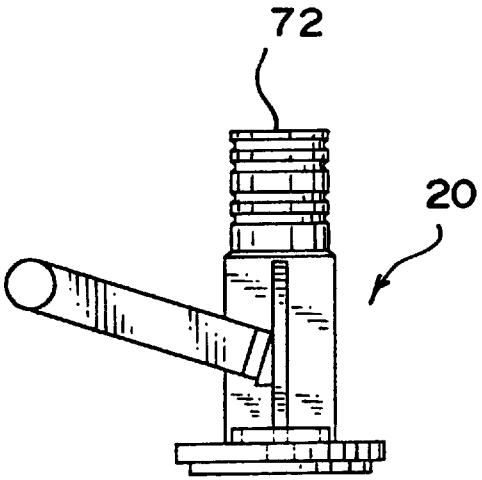
FIG. 5 is a side view of the lower screed casting.
Figure 4:
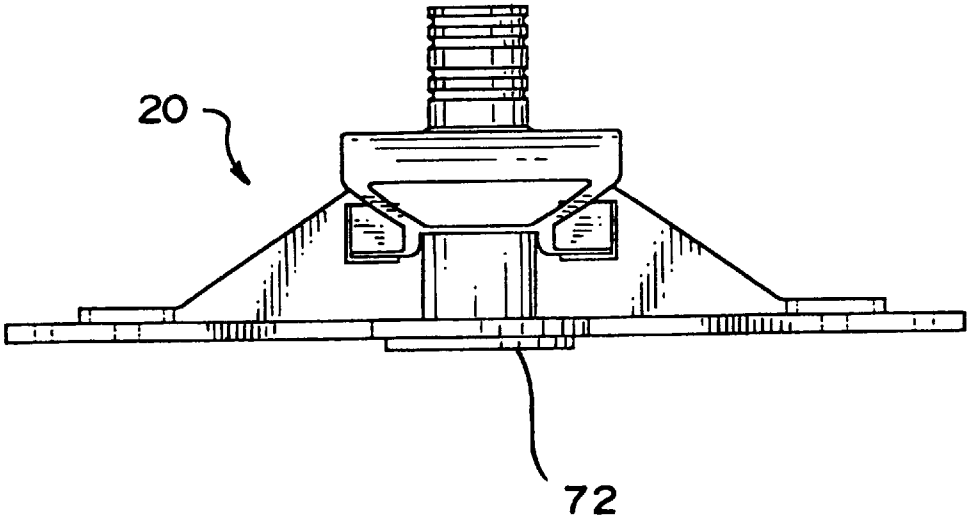
FIG. 4 is a top view of the lower screed casting.
Figure 7:
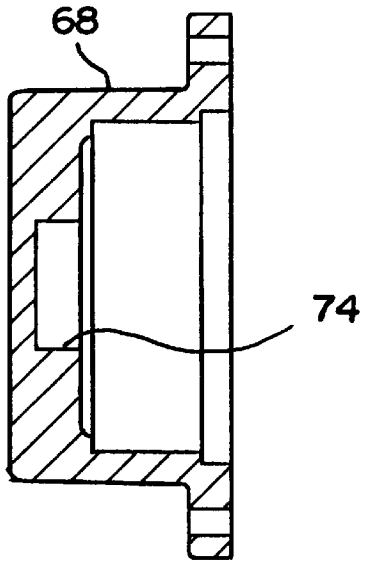
FIG. 7 is a cross-sectional view of the end cap.
Figure 8:
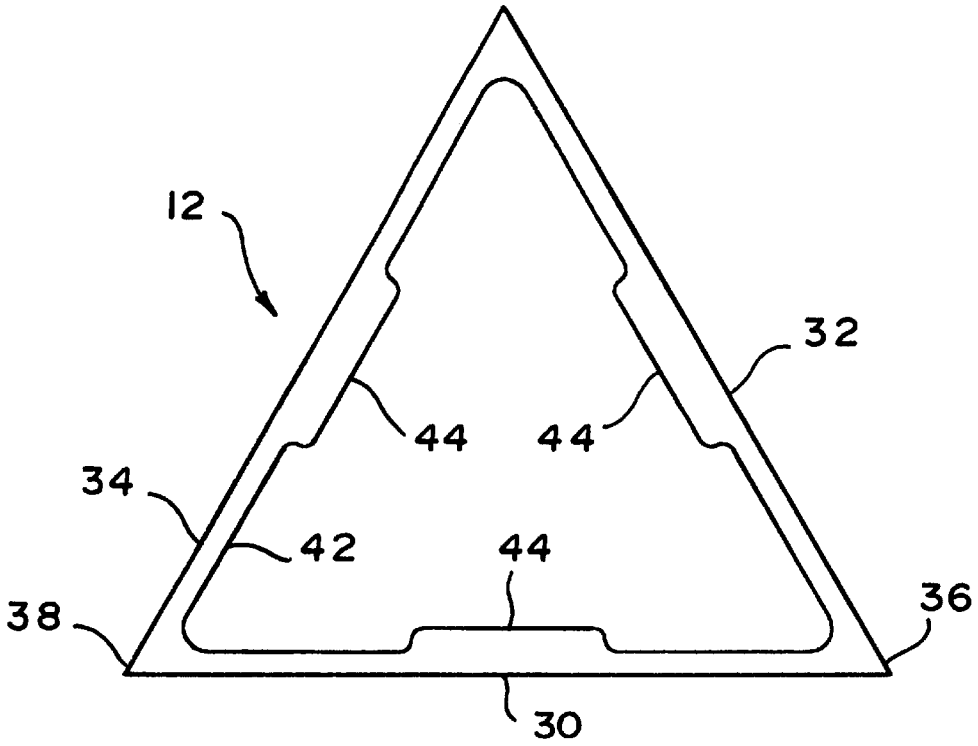
FIG. 8 is a cross-sectional view of the screed blade.

As shown in FIGS. 1, 2 and 8, the screed blade 12 is preferably extruded as one angular tube enclosed by end plates. It is an important aspect of the invention that screed blade 12 be hollow, watertight and have front and rear concrete engaging edges 36, 38 angled at approximately 60 degrees. As shown in FIG. 8, the inner surface 42 of each wall of the screed blade 12 is provided with an enlarged inwardly directed member 44 which increases the stability of the screed blade 12. Additional details regarding the construction of the screed blade 12 are found in U.S. Pat. No. 5,540,519, to Weber et al., which is incorporated herein by reference.

A screed blade mounting assembly 14 couples the vibratory assembly 16 to the screed blade 12. Specifically, the mounting assembly 14 includes a first screed blade mounting bracket 46 and a second screed blade mounting bracket 48. The first and second screed blade mounting brackets 46, 48 each include legs 50 which engage the front and rear walls 32, 34 of the screed blade 12. The first and second screed blade mounting brackets 46, 48 are secured to the screed blade 12 by bolts 52.

The vibratory assembly 16 includes a lower screed casting 20 which is directly secured to the upwardly extending arms 56 of the first and second screed blade mounting brackets 46, 48. Specifically, nuts 58, bolts 52 and locking washers 54 couple the lower screed casting 20 to the first and second screed blade mounting brackets 46, 48, and ultimately mount the vibratory assembly 16 to the screed blade 12. By securing the screed blade 12 to the vibratory assembly 16 with the first and second screed blade mounting brackets 46, 48, the vibratory assembly 16 is supported above the screed blade 12 with sufficient clearance to permit individuals to work under the vibratory assembly 16 when necessary.

The vibratory assembly 16 vibrates the screed blade 12 during operation. The vibratory assembly 16, as best viewed in FIG. 2, includes vibratory system 18 with a rotatable lower drive shaft 60 having an eccentric weight 62 coupled to its distal end 64. When the lower drive shaft 60 is rotated by the upper drive shaft 66, and ultimately the motor 28, the eccentric weight 62 rotates, causing the screed blade 12 to vibrate as a result of the eccentric mounting of the eccentric weight 62. Specifically, the eccentric weight 62 is a simply small flywheel, weighing approximately a few ounces, coupled to the distal end 64 of the lower drive shaft 60. Vibrations are created by mounting the eccentric weight 62 at an offset position on the lower drive shaft 60.

It has been found that a ⅛" offset produces ideal vibrations, although other mountings and different weight structures could be used without departing from the spirit of the present invention. The offset controls violent vibratory action encountered in other eccentric weight driven systems. The eccentric weight 62 of the present invention provides a smooth "straight line" of ever increasing vibratory action on the screed blade 12 as the motor throttle is increased; that is, the vibratory action is substantial linear with changes in the throttle of the motor 28.

As the screed blade 12 vibrates, the flat aluminum bottom wall 30 of the screed blade 12 produces a smooth, near final finish. The vibratory action tamps the rock down and works the fat into the concrete surface to substantially increase the finishing time, while making the finisher's job much easier.

The screed blade mounting brackets 44, 46 are designed to position the vibratory assembly 16 on the screed blade 12 to provide harmonic vibrations along the entire screed blade 12, as well as providing a vertical tamping effect. Specifically, the first and second screed blade mounting brackets 46, 48 support the vibratory assembly 16 such that the eccentric weight 62 is at a 60 degree angle relative to the bottom wall 30 of the screed blade 12. That is, the eccentric weight 62 rotates in a plane which is oblique, and specifically at approximately a 60 degree angle, relative to the bottom wall 30 of the screed blade 12. The orientation of the eccentric weight 62 creates a horizontal component and a vertical component when the screed blade 12 is positioned on, and moved along, a flat slab of concrete. As one of ordinary skill in the art will certainly appreciate, the vibratory action of the vibratory system 18 may be adjusted by slightly tilting the screed 10. Specifically, by tilting the screed 10 back, the operator may decrease the tamping vibrations (up and down vibrations) and increase the harmonic vibrations (lateral vibrations).

The vibratory system 18 also includes an end cap 68 which covers the eccentric weight 62 and is secured to the lower screed casting 20 supported by the first and second screed blade mounting brackets 46, 48. The end cap 68 is designed to fully cover the eccentric weight 62, the lower drive shaft 60, and the various bearings 70 supporting the eccentric weight 62 on the lower drive shaft 60. In addition, the end cap 68 and the lower screed casting 20 are offset and machined to form a watertight seal similar to that of the head and engine block seal found in an automobile engine.

Since the vibratory assembly 16 is supported by the screed blade mounting assembly 14, and particularly, the lower screed casting 20, the lower screed casting 20 is provided with a central hole 72 allowing energy supplied by the motor 28 to pass through the handle assembly 26, the stainless outer tube 24, the lower unit mounting bracket 22, and into the vibratory system 18. Specifically, the motor 28 drives the upper drive shaft 66, which in turn drives the lower drive shaft 60 to rotate the eccentric weight 62.

Vibrations within the end cap 68 are lessened by the provision of bearings 70 on both sides of the eccentric weight 62, as well as a plurality of bearings 70 positioned along the upper drive shaft 66. Specifically, the end cap 68 is a cast formed part with a receptacle 74 in the middle of its inner surface. The receptacle 74 is machined to hold the lower end cap bearing 76. The lower end cap bearing 76 is press fitted to be perfectly flat against the bottom of the end cap 68. The lower drive shaft 60 then slides into the lower end cap bearing 76 so that at high engine RPMs the lower drive shaft 60 will not vibrate excessively and produce excessive harmonic action which would transfer through the drive shafts and eventually to the operator.

The vibratory assembly 16 is driven by a motor 28 mounted at the end of the handle assembly 26. A lower unit mounting bracket 22, stainless outer tube 24, and handle assembly 26 connect the motor 28 to the vibratory system 18. Specifically, the lower unit mounting bracket 22 is coupled to the lower screed casting 20 by a pair of bolts 52 with vibratory pads 78 positioned between the lower screed casting 20 and lower unit mounting bracket 22. The vibratory pads 78 lessen the transmission of vibrations to the user of the present screed 10.

The lower unit mounting bracket 22 is also provided with a central hole 80 through which the upper drive shaft 66 extends to meet the lower drive shaft 60 of the vibratory assembly 16. The upper drive shaft 66 is coupled to the lower drive shaft 60 of the vibratory assembly 16 by a flexible shaft connector 82. The flexible shaft connector 82 limits vibrations transferred up the handle assembly 26 to the user of the screed 10. The flexible shaft connector 82 also provides a break point in the event of mechanical failure.

The central hole 80 in the lower unit mounting bracket 22 includes a first end 84 which is coupled to the distal side of the central hole 72 in the lower screed casting 20. As with the central hole 80 of the lower unit mounting bracket 22, the central hole 72 in the lower screed casting 20 provides a passage through which the upper dive shaft 66 may pass to engage the lower drive shaft 60.

Attachment of the central hole 80 of the lower unit mounting bracket 22 to the central hole 72 of the lower screed casting 72 is completed by telescopically positioning the proximal end of the central hole 80 in the lower unit mounting bracket 22 over a projection at the distal end of the lower screed casting 20 and positioning four O-rings 86 between the lower unit mounting bracket 22 and the lower screed casting 20. The O-rings 86 reduce vibrations being transmitted to the user, while also creating a watertight seal between the lower unit mounting bracket 22 and the lower screed casting 20.

Extending distally from the lower unit mounting bracket 22 is the stainless outer tube 24 housing the upper drive shaft 66. Set screws 88 securely couple the lower unit mounting bracket 22 to the stainless outer tube 24. A handle assembly 26 is mounted at the distal end of the stainless outer tube 24 by set screws 88. Specifically, the handle assembly 26 is coupled to the distal end of the stainless outer tube 24, and the distal end of the upper drive shaft 66 extends from the distal end of the stainless tube 24, through the handle assembly 26 and into the motor 28.

The handle assembly 26 includes an arm 90 which extends under the motor 28 to the distal end of the present screed 10. The arm 90 is provided with a T-handle mounting bracket 92 at its free end. The T-handle mounting bracket 92 is shaped to receive the attachment arm 94 of a T-handle 96. The attachment arm 94 of the T-handle 96 is selectively held within the T-handle mounting bracket 92 by a compression screw 98 held on the T-handle mounting bracket 92. In this way the height of the T-handle 96 may be selectively adjusted by simply loosening and tightening the compression screw 98. As such, the T-handle 96 is adjustable so that operators of different heights can adjust the handle to maintain proper screed bar position on the concrete.

A foot weldment 100, or kick stand, is provided for attachment to the T-handle 96. The foot weldment 100 telescopically fits within the lower end 102 of the attachment arm 94 of the T-handle 96 and extends to directly support the distal end of the screed 10 on the ground. The foot weldment 100 is selectively held within the attachment arm 94 of the T-handle 96 by a restraining pin 104, permitting the height of the foot weldment 100 to be adjusted as the circumstances dictate. As such, the foot weldment 100 and the attachment arm 94 of the T-handle 96 are provided with a plurality of holes 106 for engagement by the restraining pin 104.

The motor 28 includes a gas powered engine 108, a drive spindle 110 and throttle control 114. The engine 108 is a conventional item such as those commonly used to drive grass trimming devices and is removably mounted such that spindle 110 engages the portion of upper drive shaft 66 extending from the handle assembly 26.

In operation, the operator stands in freshly poured concrete and allows the screed blade to float. The screed smooths a 12–16 foot wide section of concrete, while others work around the operator to rake concrete to the areas necessary. If the amount of concrete needs to be cut down, the operator lowers the handle which causes the 60 degree rear concrete engaging edge to remove concrete from the area, and thereby lowering the grade height. If the handle is raised, the 60 degree front concrete engaging edge of the screed blade floats over, and tamps down, the wet concrete to maintain the desired grade. The flat bottom surface extending from the front concrete engaging edge to the rear concrete engaging edge of the screed blade functions to produce a smooth, near final finish, while the vibratory action tamps the rock down and works the fat into the concrete surface, thereby substantially increasing the finishing time while making the finisher's job much easier.

Should a user wish to soften the tamping effect for use in slumps of 8" or 9" (where only horizontal vibration is needed) the operator merely raises the front of the screed blade between ⅜" to ⅝" above the concrete while operating the tool. The dual action is unique among all vibratory screeds and makes the present invention capable of producing a top quality results under all conditions.

The screed blade may also be employed to detect and fix humps and bumps within a slab. Specifically, due to the triangular design of the screed blade, the present screed may be used as a straight edge to check the flatness of the slab after the slab has been powered troweled. With the power vibratory action on idle, the screed can be pulled along the surface of the slab. If a hump or bump is detected (by vibrations at the screed blade), the operator pushes the present screed back, applies a little throttle, and the sharp cutting edge found on the concrete engaging edge of the screed blade will cut through and peel the bump off the surface of the slab.

As discussed above, the screed blade is preferably extruded aluminum. In addition, and with the exception of the drive shaft and the outer stainless tube, the remaining parts are preferably cast aluminum. The drive shaft and the outer stainless tube are preferably stainless steel. While preferred materials are disclosed above, other materials may be used without departing from the spirit of the present invention.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A portable vibratory concrete screed, comprising:

a screed blade including a flat bottom wall extending between a front edge of the screed blade and a rear edge of the screed blade;

a vibratory assembly, including an eccentric weight, coupled to the screed blade, wherein the eccentric weight rotates in a plane which is oblique to the bottom wall of the screed blade; and the vibratory assembly also including a handle assembly coupling a motor to the eccentric weight to drive the eccentric weight and vibrate the screed blade.

2. The portable vibratory concrete screed according to claim 1, wherein the eccentric weight rotates in a plane which is approximately 60° relative to the bottom wall of the screed blade.

3. The portable vibratory concrete screed according to claim 1, wherein the vibratory assembly includes a drive shaft upon which the eccentric weight is mounted, the eccentric weight being mounted offset on the drive shaft.

4. The portable vibratory concrete screed according to claim 1, further including a screed blade mounting assembly coupling the vibratory assembly to the screed blade.

5. The portable vibratory concrete screed according to claim 4, wherein the screed blade mounting assembly includes mounting brackets supporting the vibratory assembly above the screed blade.

6. The portable vibratory concrete screed according to claim 4, wherein vibratory pads are positioned between the eccentric weight and the handle assembly to lessen vibrations transmitted to a user.

7. The portable vibratory concrete screed according to claim 4, wherein a lower screed casting supports the eccentric weight and a lower unit mounting bracket couples the handle assembly to the lower screed casting, and an O-ring is positioned between the lower screed casting and the lower unit mounting bracket to lessen vibrations transmitted to a user and create a water tight seal between the lower unit mounting bracket and the lower screed casting.

8. The portable vibratory concrete screed according to claim 4, wherein the vibratory assembly includes an end cap to encase the eccentric weight.

9. The portable vibratory concrete screed according to claim 1, wherein the vibratory assembly includes an end cap covering the eccentric weight.

10. The portable vibratory concrete screed according to claim 9, wherein the vibratory assembly includes at least one bearing on the drive shaft to lessen vibrations.

11. The portable vibratory concrete screed according to claim 1, wherein the motor is secured to the distal end of the handle assembly.

12. The portable vibratory concrete screed according to claim 1, wherein the handle assembly includes a handle mounting bracket supporting a handle.

13. The portable vibratory concrete screed according to claim 12, wherein the handle is adjustably mounted on the handle mounting bracket for adjustment to suit users of different sizes.

14. The portable vibratory concrete screed according to claim 1, wherein the screed blade has a triangular cross section.

15. The portable vibratory concrete screed according to claim 1, wherein the screed blade is formed from a hollow extrusion.

16. The portable vibratory concrete screed according to claim 1, wherein the screed blade is less than 16 feet in length.

17. The portable vibratory concrete screed according to claim 1, wherein the screed blade is an elongated tubular screed blade which is triangular in cross section and includes a pair of opposed sides, a bottom and a pair of opposed ends, thereby forming an enclosed triangular blade.

18. The portable vibratory concrete screed according to claim 1, wherein the screed blade is an elongated, enclosed, hollow screed blade including a front 60 degree concrete engaging edge and surface, a rear 60 degree concrete engaging edge and surface and a flat bottom wall extending between the front and rear edges.

19. The portable vibratory concrete screed according to claim 1, wherein a drive shaft couples the motor to the eccentric weight.

20. The portable vibratory concrete screed according to claim 19, wherein an upper drive shaft is coupled to the motor and a lower drive shaft is coupled to the eccentric weight, and the lower drive shaft is coupled to the upper drive shaft by a flexible shaft connector.

* * * * *